United States Patent [19]

Geary et al.

[11] 4,099,485

[45] Jul. 11, 1978

[54] APPARATUS FOR APPLYING FLOCK TO A SUBSTRATE

[75] Inventors: Joseph E. Geary, Rochester; Joseph Pelensky, Perry; John Peter Hart, Leicester, all of N.Y.

[73] Assignee: Champion Products Inc., Rochester, N.Y.

[21] Appl. No.: 714,608

[22] Filed: Aug. 16, 1976

[51] Int. Cl.[2] ..... B05B 15/04

[52] U.S. Cl. ..... 118/301; 118/308; 118/421; 118/629; 118/DIG. 5; 427/185

[58] Field of Search ..... 118/308, 309, 301, 323, 118/421, 629, 631, 634, DIG. 5; 427/185, 197, 206; 101/DIG. 13, 123

[56] References Cited

U.S. PATENT DOCUMENTS

| | | | |
|---|---|---|---|
| 3,138,483 | 6/1964 | Dettling et al. | 118/421 X |
| 3,185,131 | 5/1965 | Manning | 118/421 |
| 3,254,625 | 6/1966 | Armstrong | 118/421 X |
| 3,280,794 | 10/1966 | Rosenberg | 118/301 |
| 3,370,569 | 2/1968 | Runge | 118/639 |
| 3,590,776 | 7/1971 | Tudor et al. | 118/5 |
| 3,856,498 | 12/1974 | Campagna | 427/185 |
| 3,875,898 | 4/1975 | Braden | 118/421 |
| 3,927,943 | 12/1975 | Pohl et al. | 101/DIG. 12 |

*Primary Examiner*—Mervin Stein
*Attorney, Agent, or Firm*—Schovee & Boston

[57] ABSTRACT

A flocking system including a cabinet supporting a substrate to be flocked and a flock tray, means for raising and lowering the flock tray into and out of contact with the substrate (such as a garment), and means for sealing the moving flock tray to the cabinet to prevent flock from getting into the cabinet to prevent contamination of the mechanics of the internal portion of the cabinet by flock. The flock tray includes a slowly rotating rotor for keeping the flock agitated, a telescoping shaft connecting the rotor to the motor, a flock tray holder for maintaining the seal with the cabinet, and a flock tray cover with one or more flocking masks with various size openings.

23 Claims, 8 Drawing Figures

APPARATUS FOR APPLYING FLOCK TO A SUBSTRATE

BACKGROUND OF THE INVENTION

1. Field of the Invention

This invention relates to the art of flocking and in particular to an improved flocking tray system.

2. Description of the Prior Art

In the art of flocking, it is known to provide an adhesive coating of a predetermined design to a substrate such as a garment, textile, card, etc. such as by screen printing to cover the adhesive with flock, and then to heat the substrate to cure the adhesive. The flock, of course, will adhere only to the adhesive coated portion of the substrate and after all excess flock is removed and the adhesive cured, the desired design on the garment will be "flocked" or fuzzy in both appearance and texture. The term "flock" as known in the prior art refers usually to a very short, natural or synthetic fiber such as may be used in coating greeting cards, garments or the like, such as fibers of rayon, nylon, polyester or pulp. It is known to apply flocking material to an adhesive coated surface in a variety of ways including manually depositing fibers over the entire surface and shaking off the excess, and more recently by the use of electrostatic devices which provide the advantage that the fibers are driven into the surface substantially on end with each fiber standing up. This gives a deeper penetration into the adhesive and a more textured and more uniform coating. It is well-known in the prior art to apply flocking to garments such as T-shirts, sweat shirts and the like, however, the overall operation requires a large amount of operator time and hand work. In many of the conventional systems, a motor and cam or lever action system is utilized, in which systems binding and other problems occur such as contamination of the inside of the cabinet with flock.

It is an object of the present invention to provide an improved flock tray system which overcomes or minimizes some of the above-mentioned problems in the prior art, such as binding of the moving tray and contamination of the inside of the cabinet with flock.

SUMMARY OF THE INVENTION

In a flocking system, an apparatus for raising and lowering a flock tray in which the inside of the cabinet is sealed against contamination by the flock while simultaneously guiding the movement of the flock tray. Preferably a pair of felt seals are positioned in the tray shaftway which seals contact the flock tray holder and simultaneously guide the tray movement and accomplish the sealing. Deposition of flock on background areas of the garment to be flocked is prevented by means of one or more masks. A rotor in the flock tray keeps the flock agitated and a telescoping drive-shaft from a stationery motor in the cabinet can be used to maintain rotation of the rotor during up and down movement of the flock tray.

BRIEF DESCRIPTION OF THE DRAWINGS

The present invention will be more fully understood by reference to the following detailed description thereof, when read in conjunction with the attached drawings, wherein like reference numerals refer to like elements and wherein.

DETAILED DESCRIPTION OF THE PREFERRED EMBODIMENTS

Figure 1:
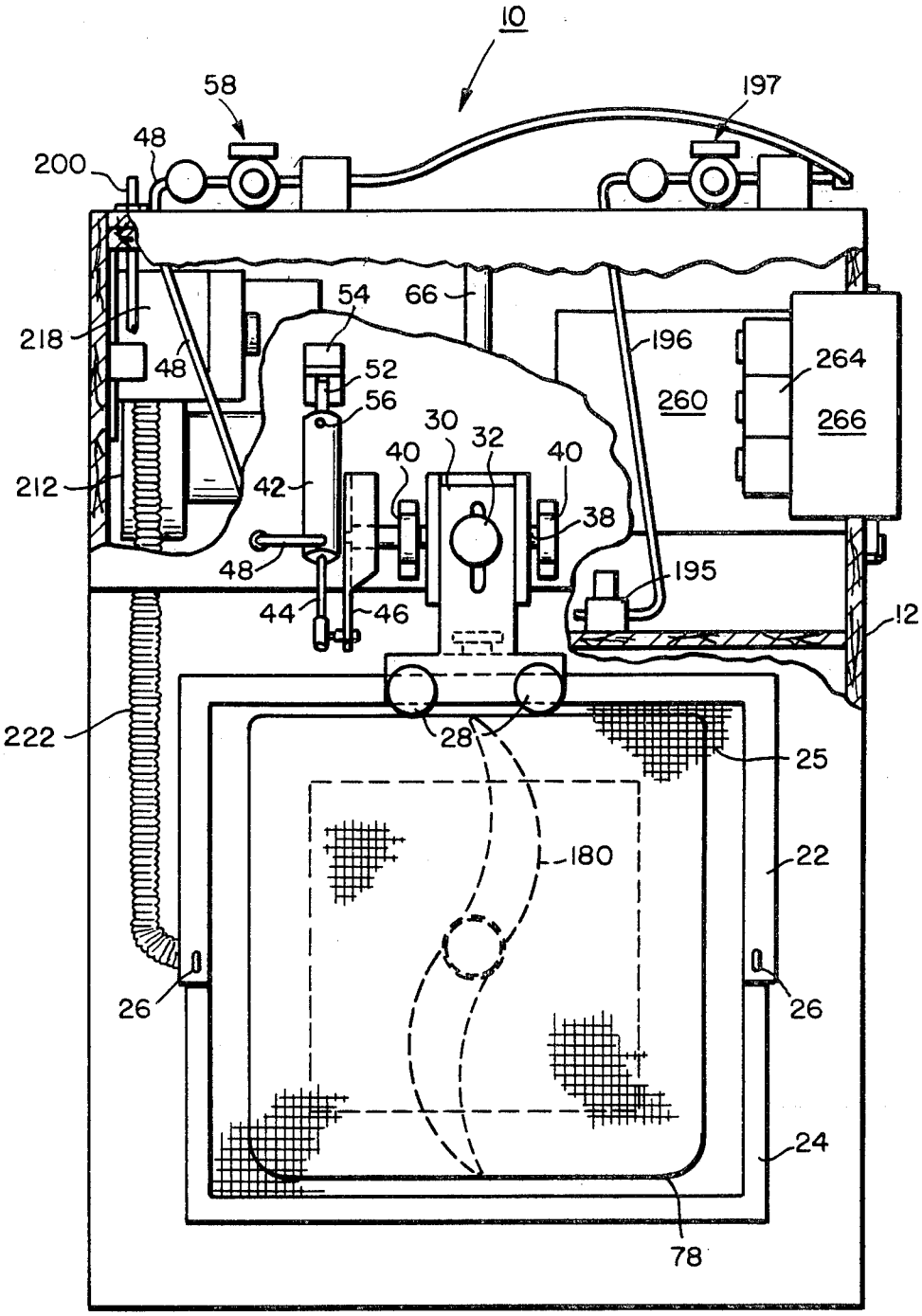
FIGS. 1–4 are partly cross-sectional top, front, side and rear elevational views of a flocking machine according to the present invention.

With reference now to the drawings showing a semi-automatic flocking machine 10 according to the present invention, it is believed that a preliminary overview of the machine 10 from the operator's point of view will be helpful. The purpose of the flocking machine 10 is to apply a predetermined design of flock on a substrate, such as a garment, for example, a T-shirt. The machine 10 has a single ended rotatable garment-holding turret with two platens 78 on each of which a T-shirt is mounted. Above the turret is an adhesive applying station and below the turret is a flock applying station. The operator (1) opens up a shirt (shirt A) and slides it over the uppermost platen where it is automatically retained (2)pulls down a screen printing apparatus on top of the shirt, manually squeeges adhesive through the screen onto the shirt, and then pushes the screen back up (an automatic printing head can be installed if desired). (3) manually rotates the turret 180°, (4) removes from the uppermost platen the previous shirt (shirt B) which had flock applied to it automatically by the flock applying apparatus while the operator was applying adhesive to the subsequent shirt (shirt A), and then (5) repeats steps 1–4. A single operator using the flocking machine 10 of this invention can prepare between about 80 and 140 dozen shirts a day.

The flocking machine 10 is totally compact, portable and self-contained. Everything is within the machine 10 and can be transported or moved from one area of a production plant to another with only the need for attaching air lines, water lines and electrical power. The unit is totally independent of the need for external atmospheric control.

The machine 10 comprises a cabinet 12, an adhesive applying apparatus 14, a flocking apparatus 16, a garment holding turret apparatus 18, a humidification control apparatus 20, and an electrical system, each of which components will now be described in detail.

The adhesive applying apparatus 14 comprises a variable position screen frame holder 22 into which a screen printing frame 24, holding a print screen 25, is secured by means of a screen frame holding device such as thumb screws 26. The screen frame holder 22 can be made of any type of material although it is preferably aluminum channel. There can be 2, 4, 6 or more thumb screws 26 depending on the size of the screen frame. The screen frame 24 can be moved backward and forward within the master screen frame holder 22 if desired, and in addition, the variable position screen frame holder 22 itself can be moved left and right by means of the adjustable screw threaded bolts 28 and forward and backward by means of a slotted support 30 in conjunction with the screw threaded retaining bolt 32 which connects the support member 30 to a pivotable platen 34 mounted on the top surface 36 of the cabinet 12. The pivotable platen 34 is secured to the rotatable shaft 38 mounted for rotation in a pair of bearing supports 40. The screen frame holder 22 is manually raised and lowered by the operator, however, it is balanced by an air cylinder 42 having its piston rod 44 connected to an off-center bracket 46, which is connected in turn to the rotatable shaft 38. A suitable air line 48 is connected to the air cylinder 42 to provide the balancing force. The proximal end of the air cylinder 42 is hingedly connected at 42 to a support 54 on the cabinet 12. A muffler or control valve 56 may be provided on the air cylinder 42 for the purpose of preventing foreign material from getting into the air cylinder. An air control apparatus 58 including an air control valve regulator, filter and oiler is provided as is well-known in the art. An adjustable stop 59 is provided to contact the platen 34 to determine the uppermost limit of travel of the screen 24 when it is raised by the operator. From this description it can be seen that the screen frame 24 can be easily raised and lowered by the operator. In the prior art, springs and/or weights were used to help balance the screen, however, such prior art had many problems associated therewith, such as, as the ink was used up this changed the weight and threw the balancing system off whereby the weights were changed to re-balance the screen; further, the springs had a tendency to fly off with result of the possibility of injury to the operator. Change in the weight of the ink or adhesive in the present system does not effect the balance of the system. This system allows for finger-touch control, which can be adjusted by the operator at the rear of the machine 10 by means of the valve regulator of the air control apparatus 58. A print screen 25 having the desired pattern or design is inserted into the screen frame holder 22 and a quantity of adhesive is then placed inside of the screen frame. The operator can manually by means for example by a squeegy, force the adhesive through the print screen onto a garment held on the garment holding turret apparatus 18 (described below). The flock adhesive is applied as in the conventional, known state of the art by forcing the adhesive through the silk screen 25, known as screen printing. The screen frame can be made of wood, metal, plastic, etc., and the screen 25 can be of any of the man-made or natural fibers of any desired mesh count. The screen has the desired graphic design on it and the adhesive forced through the screen puts the design directly onto the garment. Following the application of flock to the garment, the garment is removed from the device and placed in an oven for curing of the adhesives, all of which is well-known to those skilled in the art.

The garment holding turret apparatus 18 includes a pair of garment holding platens 78, a garment holding device 62, and a detent indexing system 64. This garment holding apparatus has the advantage of having no supports or assembly adjacent the chest or stomach of the operator to hinder the operator's movements in placing the garment in and around the platens 78 or in the screen printing operation (whether adhesive or ink). Further, in the present invention, the turret can be rotated in one direction (such as clockwise) without activating the high voltage and in the other direction (for example, counterclockwise) to activate the high voltage for the flock cycle. In this way, in setting up the machine, if the operator wishes to predetermine a masking area or a printing area, or to make another adjustment but does not want the high voltage to go on, or to raise the flock from the tray to the platen, all the operator has to do is rotate the turret in a clockwise direction and the flock cycle will not be activated. This feature aids in rapid set up without the need for turning on or off switches and thus minimizes the set up time and the consequent frustration on the part of the operator, and is in contrast to the prior art in which, when the operator rotates a turret in either direction from the printing position to the flocking position, the high voltage is activated.

Figure 2:
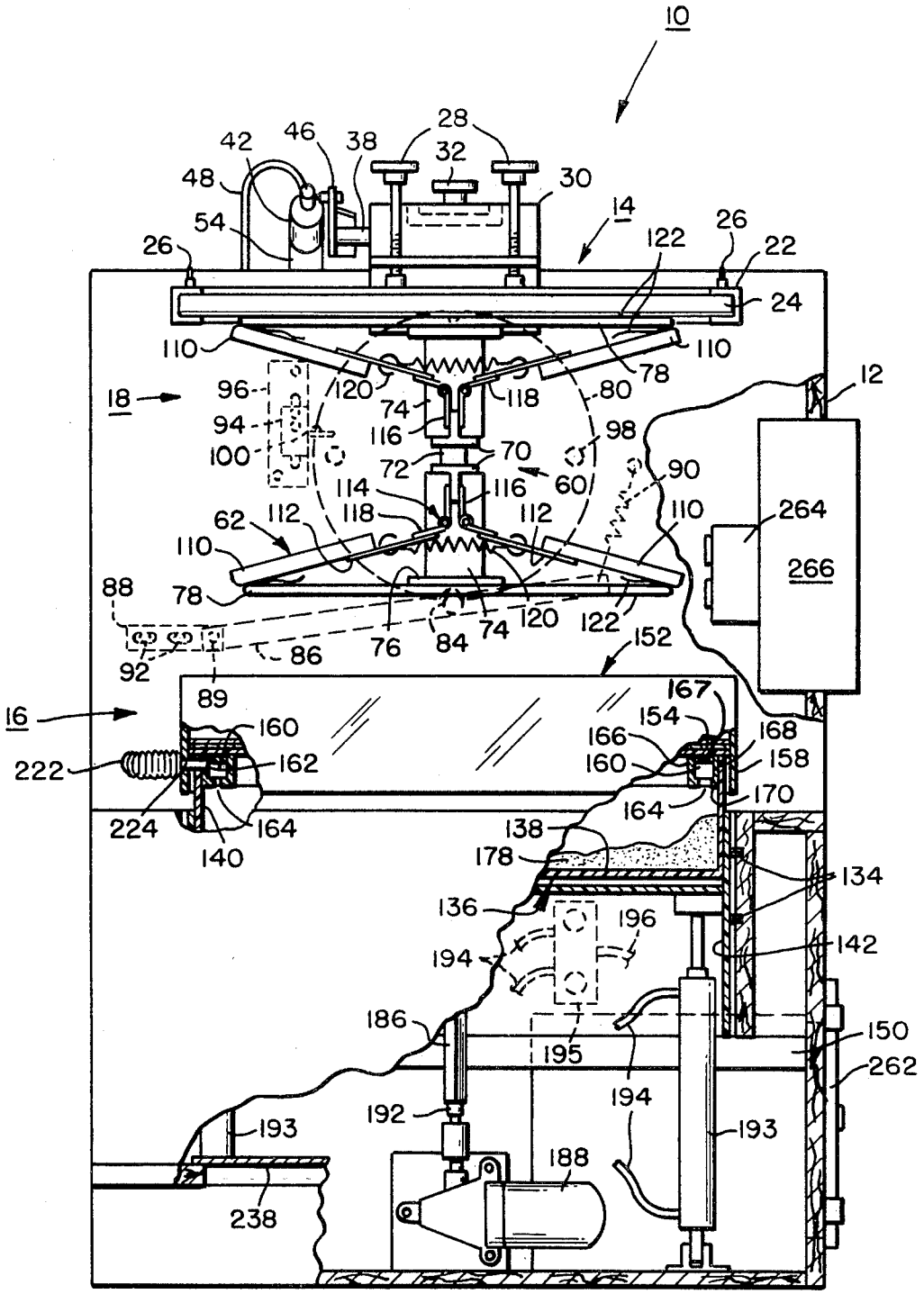
Figure 3:
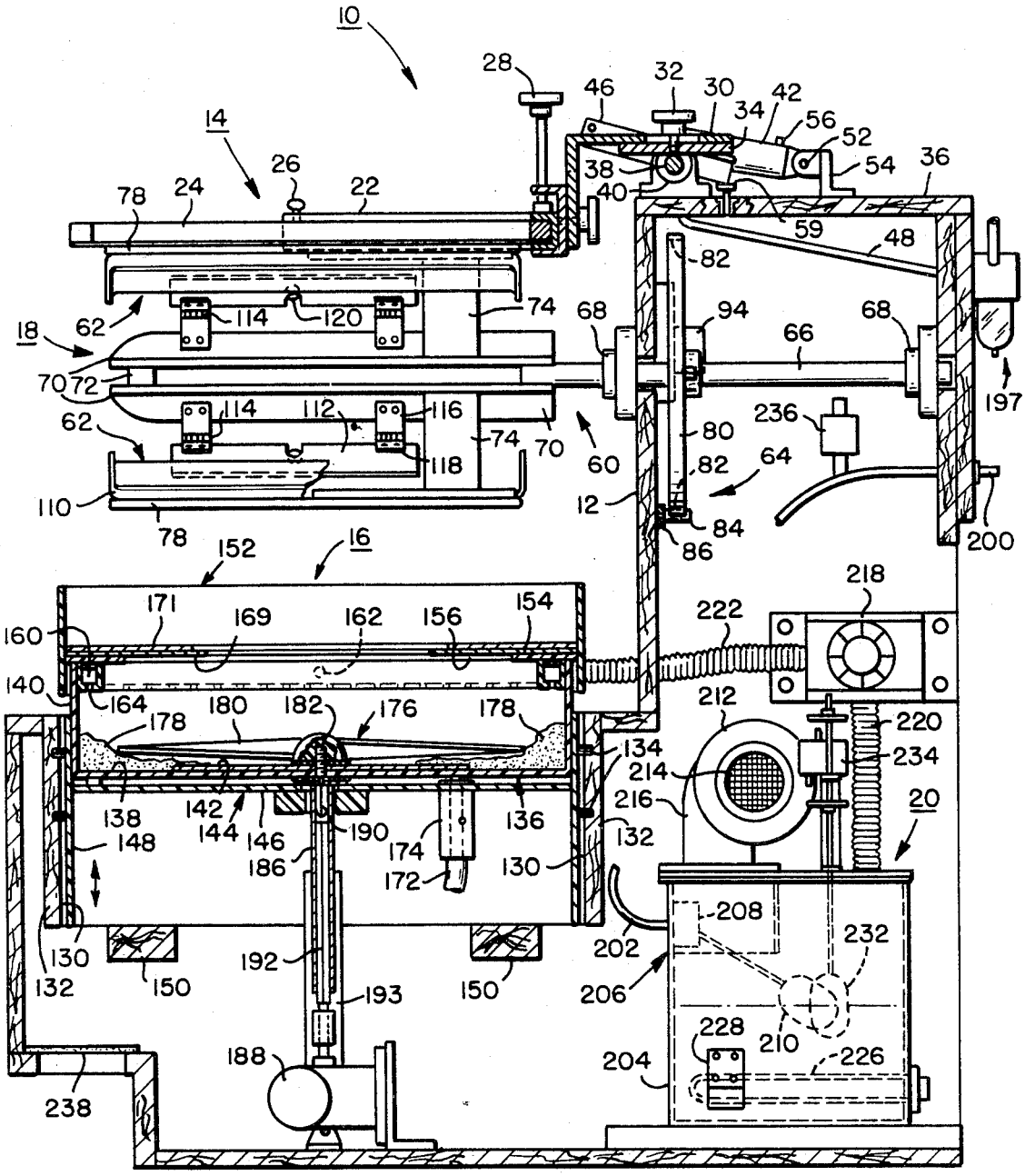

The garment holding apparatus comprises (as best shown in FIGS. 2 and 3) a horizontal turret shaft 66 journaled in bearings 68 mounted on the cabinet 12. Connected to the distal end of the shaft 66 are a pair of T-shaped support members 70 with a brace 72 between the distal ends of the member 70. Extending outwardly from each of the members 70 is a platen holding support 74 connected at its distal end to a turret platen support 76 which in turn supports a platen 78. The platens 78 are preferably metal and in a preferred embodiment are aluminum because of its light weight. The platens 78 are negatively grounded in the electrical system described in more detail below.

Figure 4:
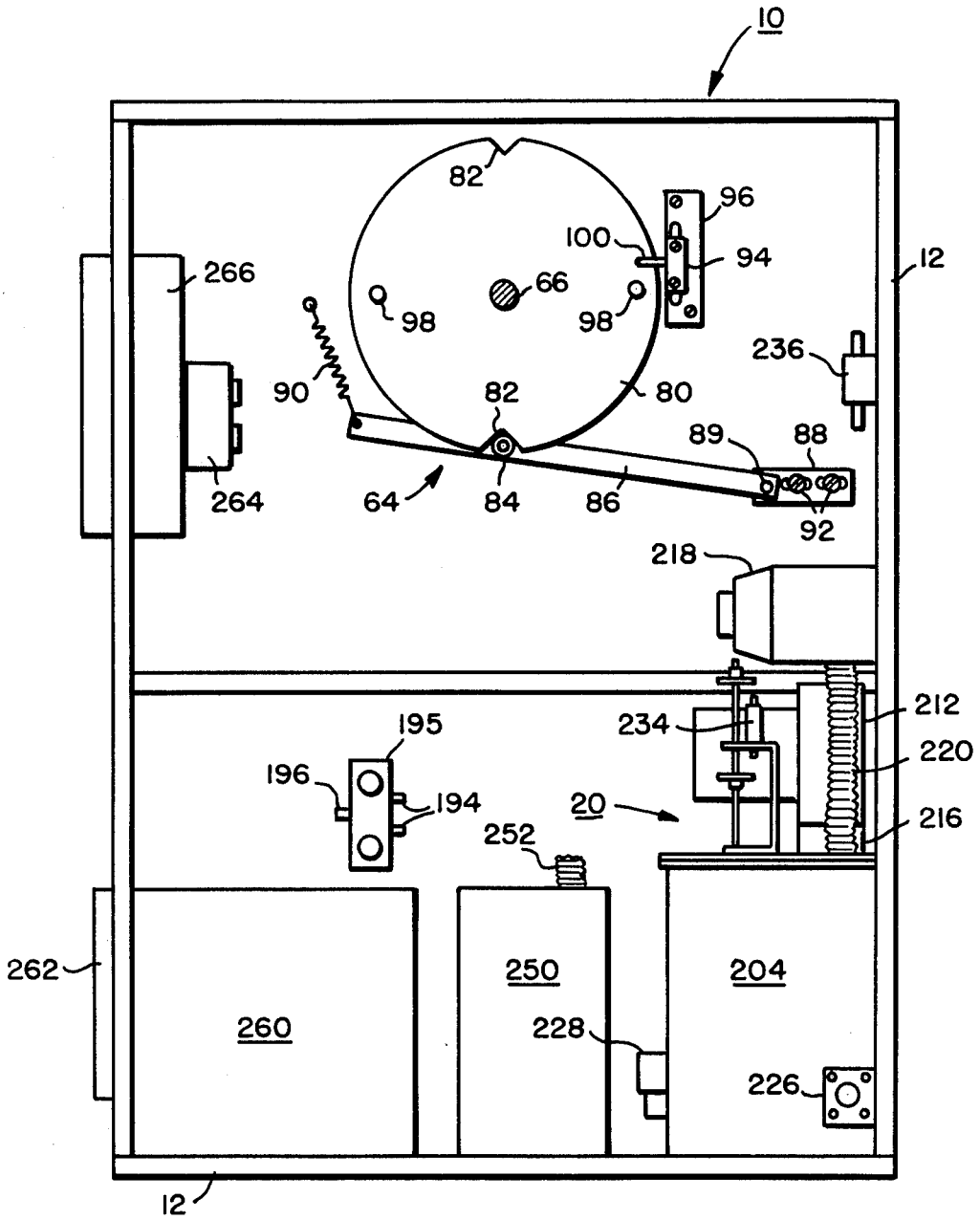

The detent indexing system 64 (see FIGS. 2–4) comprises an index wheel 80 connected for rotation to the turret shaft 66 and having a pair of detent grooves 82 diametrically opposed on the periphery of the index wheel 80. A detent wheel 84 adapted to detentably mate with the detent grooves 82 is mounted on a detent arm 86 pivotally connected to the cabinet 12 by means of a detent arm bracket 88. A detent spring 90 connected at one end to the detent arm 86 and at the other end to the cabinet 12 urges the detent arm 86 and thus the detent wheel 84, toward the index wheel 80. The location of the detent wheel 84 can be adjusted by means of the bolts 92 which attach the detent arm bracket 88 to the cabinet 12 and which extend through elongated slots in the detent arm bracket 88. The detent arm and thus the detent wheel 84 can thus be moved back and forth to properly locate the detent wheel 84. A microswitch 94 is located inside the cabinet 12 adjacent the index wheel 80 and is attached to the cabinet by an adjustable microswitch mount 96. The back of the index wheel 80 includes a pair of actuating pins 98 for engaging a contact arm 100 of the microswitch 94. The microswitch 94 is activated when the index wheel 80 moves in a counterclockwise direction (looking at the machine 10 from the front) but is not activated when the index wheel moves in a clockwise direction, to provide the advantages mentioned above. This is accomplished by the arm 100 being a one-way arm (such as a spring-biased hinged arm).

The garment holding device 62 (see FIGS. 2 and 3) comprises, for each of the platens 78, a pair of outer wings 110 each connected to a wing holding plate 112 which in turn is connected to a pair of hinge members 114. The hinge members include a first plate 116 fixedly connected to the T-shaped support member 70 and a second plate 118 hingedly connected to the first plate and secured to the wing holding plate 112. A compression spring 120 is connected between each pair of wing holding plates 112 to urge them toward each other and thus into contact with the platens 78. The garment holding device 62 thus provides a means for holding any excess portions of a garment 122 (see FIG. 2) in place during the adhesive and flock applying cycles. This holding device 62 is thus always in the retaining position (that is, it need not be put up and down as in prior art equipment on the market). The various elements of the holding device 62 of the present invention can be made of any desired material, such as plastic, composition board, metal or whatever. Various types, styles and sizes of holding wings 110 can be attached to the wing holding plates 112 depending on the size of the platens 78 being used and the type of substrate or garment being printed. As can be seen from the drawings, the wings 110 have rounded corners and rounded edges (the edges adjacent the platens 78), whereby the wings are easily moved away from the platen by the motion of the fingers and the garment as the garment is pulled onto the platen. This holding device 62 allows an operator to merely slide the fingers and garment between the platen and the wings 110. As the shirt tail of the garment, for example, reaches the back of the platen, the operator begins a forward movement with the hands and automatically tucks the shirt tail of the garment underneath the wings and in coming forward, removes the wrinkles in the garment on the platen surface. As the operator's hands approach the front of the machine, the operator merely tucks the collar or neck portion, sleeves, etc. of the garment between the wings and the platen. These wings are holding devices that are spring loaded and so designed as to the angles and configuration to provide this feature. This operation is a time saver and a positive holding device for the textile or garment. The time saving feature is that it eliminates the operator from extra fumbling in reaching and lowering the holding device around the garment and trying at the same time to tuck the textile into the holding device and then raising the holding device into the retaining position. The system also minimizes the extra operation, wherein when removing the garment, the operator need not disengage the holding devices. The operator merely grasps the garment 122 and pulls it from the platen 78.

Referring now to the flocking apparatus 16, in many conventional systems a motor and cam or lever action system is utilized to raise and lower the flock tray. In these systems binding and other problems occur. The apparatus of the present invention overcomes and/or minimizes many of the prior art problems. The flocking apparatus 16 of the present invention comprises (see FIGS. 2 and 3) a shaftway 130, defined by vertical shaft walls 132. A pair of seals 134 are located on the surface of the shaft walls 132. The seals 134 can be a packing material such as felt, plastic, etc. In the preferred embodiment felt is used. The seals 134 provide the two functions of giving guidance to the master tray in its up and down motion, and of sealing out any contamination of foreign material from getting into the cabinet 12. In prior art units, it has been observed that flock is sucked into the cabinet and contaminates the internal workings and can eventually short out one or more aspects of the system. As can be seen in FIG. 3 of the drawing, the slidable wall 148 does not actually contact the shaftway 130 but only the felt seals 134.

The flocking apparatus 16 also includes a removable flock tray 136 having a floor 138 and side walls 140. An electrode 142 is located on the floor 138 of the tray 136. In the preferred embodiment, the electrode 142 comprises an aluminum plate 1/16 inch thick to which the positive terminal of the electrostatic field system is connected when the electric field is activated. The flock tray 136 is supported in a flock tray holder 144 having a floor 146 and vertical side walls 148 which extend both upwardly and downwardly from the floor 146. The downward extension of the side walls 148 is such that they are in contact with both of the shaft seals 134 even when the tray 136 is in its uppermost position (in contact with the lowermost platen 78) during the flocking cycle. A pair of flock tray holder stops 150 are provided for defining the lowermost extension of motion of the flock tray holder 144. A flock tray cover 152 hving a floor 154 with an opening 156 therein and vertical sidewalls 158 is positioned on top of the flock tray 136. Positioned around the periphery of the flock tray 136 is an enclosed air duct 160 having an entrance opening 162 (which will be described in more detail hereinafter) and having discharge perforations 164 in a bottom wall thereof. The walls defining the air duct 160 can be made a part of either the flock tray 136 or the flock tray cover 152. In a preferred embodiment the air duct is formed as a square plastic tube having two vertical walls 166 and 168 a bottom wall 170 and a top wall 167, fastened (e.g. bonded) to the floor 154 of the cover 152.

According to a preferred embodiment of the invention, located on top of the floor 154 of the flock tray cover 152 is a plastic mask 169 having an opening therein approximately the size of the design area of the garment, and located on top of the plastic mask 169 is a cardboard mask 171 having an opening just larger than that of the design to be flocked. The purpose of these masks is to prevent flock from being shot into and adhering to background areas of the garment from which it would have to be removed. The masks can be changed when the screens are changed. The reason for using both the plastic and cardboard mask is that the plastic mask opening is in relation to the platen size while the cardboard mask in in relation to the design size and shape.

The flocking apparatus 16 also includes a high voltage cable 172 (see FIG. 3), and a high voltage cable retainer or bracket 174 connected to the floor 146 of the flock tray holder 144. The high voltage cable 172 extends through the floors 146 and 138 into electrical contact with the electrode 142.

The flocking apparatus 16 also includes an agitator apparatus 176 to keep the flock 178 (see FIG. 3) agitated. If agitation is not accomplished, positive humidity control cannot be established. Also, after a certain number of flock cycles the flock can form a skin or layer of flock over the top surface thereof in the flock tray, which can change the electric field and can inactivate the movement of the flock from the flock tray to the adhesive and substrate. The agitator apparatus 176 of the present invention comprises a slowly rotating, nonmetallic (preferably plastic) motorized rotor 180 located in the bottom of the flock tray 136 and connected to a drive pin 182 which extends through the floor 138 of the flock tray 136 and also through the floor 146 of the flock tray holder 144. The drive pin 182 is connected to a collar 186. A variable speed motor 188 is located in the bottom of the cabinet 12 and is connected to a drive shaft 190 which is square and which fits inside of the hollow square collar 186 and which is thus in telescoping sliding relationship with the collar 186, so that driving engagement therebetween is maintained even as the flock tray 136 moves up and down.

The driving arrangement of the agitator apparatus can alternatively include a motor and shaft connected directly to the floor 146 of the flock tray holder 44 to eliminate the need for the telescoping drive shaft arrangement. A very slow rotational speed, such as 10 rpm, is employed so that the operator cannot be injured even if the operator contacts the rotor.

The flocking system 16 also includes means for raising and lowering the flock trays including a plurality of (preferably two) air cylinders 193 located beneath the flock trays and having the bottom end thereof connected to the bottom of the cabinet and a piston rod thereof connected to the floor 146 of the flock tray holder 144. Air lines 194 are connected to the air cylinders 193 for operating the air cylinders. A solenoid controlled valve 195 (preferably have one "up" solenoid and a separate "down" solenoid) is connected to the air lines 194 with an input air line 196 extending from an air system 197 including an air control valve, regulator, filter and oiler. While the up and down strokes of the air cylinders 193 are controlled and limited when the machine is designed, the design is such that the flock tray actually makes contact with the platen 78; it is this actual contact which stops the upward motion of the tray.

Referring now to the humidity control apparatus 20 of the present invention, it is generally known in the art that to do a proper and efficient flocking job, it is necessary, when using either AC or DC electrostatic systems that the application of flock be done in a controlled atmosphere. The flocking machine 10 of the present invention, however, allows the flock to be applied to a garment in a non-atmospherically controlled room without deterioration to the quality of the flock design, the receptiveness to the electric field, or to perpendicular dense coverage of flock on the adhesive substrate. The humidity control apparatus 20 of the present application keeps the moisture content of the flock at a predetermined moisture level in order to keep the flock highly receptive and active to the electrostatic field (whether it be an AC or a DC system). This controlled, internal system provides for fast flocking (moving of the flock from the flock tray to the adhesive and substrate), and the proper moisture content of the flock also assists in the proper alignment and density of the flock into the flock adhesive. An important feature of the flocking machine 10 is that in the present state of the art all flock equipment manufacturers recommend that flock be preconditioned (brought to a certain moisture content). In the machine of the present invention there is no need to precondition the flock, therefore extra cabinetry, storage, and 24 hour pre-conditioning is not necessary. Flock can be taken, which has been exposed on a daily basis to various humidity conditions, placed in the flock tray 136 and as soon as the operator is ready to start printing the adhesive and/or inks, he can start applying flock in a precise controlled manner with good density and good receptiveness to the electrostatic field.

The humidity control apparatus 20 comprises a humidifier and/or a dehumidifier depending on the climatic conditions in the area in which the machine 10 is to be used. In some areas only a humidifier is necessary whereas in other areas a combination of the humidifier and dehumidifier is necessary.

The humidifier system of the humidity control apparatus 20 comprises (see FIG. 3) a water inlet pipe 200 and a water line 202 connected between the water inlet pipe 200 and a water tank 204 located on the floor of the cabinet 12. A water inflow shut-off float system 206 is connected to the tank 204 for turning off a valve 208 to shut off the main water supply to the tank 204 when a float 210 rises to a certain predetermined level in the tank 204. A variable speed fan 212 having an air inlet 214 and an air outlet 216 is connected to the tank 204. The humidity control apparatus 20 also includes a humidistat and regulator 218 connected by a duct 220 to the tank 204 and connected by another duct 222 to the opening 162 in the air duct 160 of the flock tray. The duct 222 is a slip fit over a pipe 224 (see FIG. 2) communicating with the air duct 160 through the side walls of the flock tray cover 152 and the flock tray 136. A heater 226 is located in the tank 204 in contact with the water for heating the water. A thermostat control 228 having a sensitive element within the water in the tank 204 and having the control knob on the outside of the thermostatic control 228 provides adjustability of the temperature to a predetermined desired temperature of the water in the tank 204. The thermostat thus controls the energization of the heating element 226. A float electronic safety system is provided including a float 232 and an electric switch 234 for sensing when the water level is at a dangerously low level and for automatically turning off power to the heating element 226 so as not to burn out the heater when and if the water level falls below the predetermined dangerously low level. The cabinet 12 includes a filtered air inlet 238 whereby the movement of air is controlled first by the filtered air inlet 238 which allows clean air to enter into the inside of the cabinet and then be drawn through the inlet 214 of the fan 212 down into the tank 204, up through the duct 220, through the humidistat and regulator 218, through the outlet duct 222 and then into the flock tray 136 through discharge perforations 164 of the air duct 160. The controlled air flow system on the flocking machine 10 is so designed as to have a positive CFM of air whether humidified or dehumidified. This system is accomplished by means of a variable speed control 308 (FIG. 6) which is in the master control box 266 described below. The discharge orifices 164 control the amount of air flowing into the flock tray completely around its perimeter and flooding the tray with a precise amount of air of controlled humidity. The system of the present invention establishes the highest density of flock lay down on an adhesive and a substrate in a perpendicular dense manner. In a preferred embodiment, there is only a single inlet opening 162 into the air duct 160 and the perforations 164 are sized as follows: on the intake side the orifices are $\frac{1}{8}$ diameter, on the oposite side they are $\frac{1}{4}$ inch diameter, and on the intermediate two sides they are 3/16 inches in diameter. Alternatively, of course, the openings 162 could be on two adjacent sides or on all four sides, in which cases the sizes of the perforations 164 would be changed accordingly. The air flow depends on the atmospheric conditions and is very small so as not to disturb the flock either with or without the electric field. The controlled air flow system of the present invention is contrary to the teachings of the prior art wherein, although certain types of units have had humidification systems in them, up-flockers have not had such humidification systems and the state of the art teaches that there should not be any moving air in such a system. However, in the present invention, we do have movement of air which is controlled in velocity, direction and humidity and which does not hinder the application of flock, but assists in giving a good uniform coverage of flock.

The dehumidification system of this invention includes (when it is used in place of the humidifier system) a dehumidifier 250 and also the same components as discussed above with respect to the humidifier system, that is, a fan with an inlet from the cabinet and outlet to the dehumidifier, and a humidistat and control with ducts to it and from it to the duct 160 of the flock tray. While a single set of fan and humidistat and ducts could be used, by hooking them up to whichever of the humidifier or de-humidifier 250 is to be used, it is preferred to have a separate complete system for each of the humidifier and dehumidifier.

Figure 5:
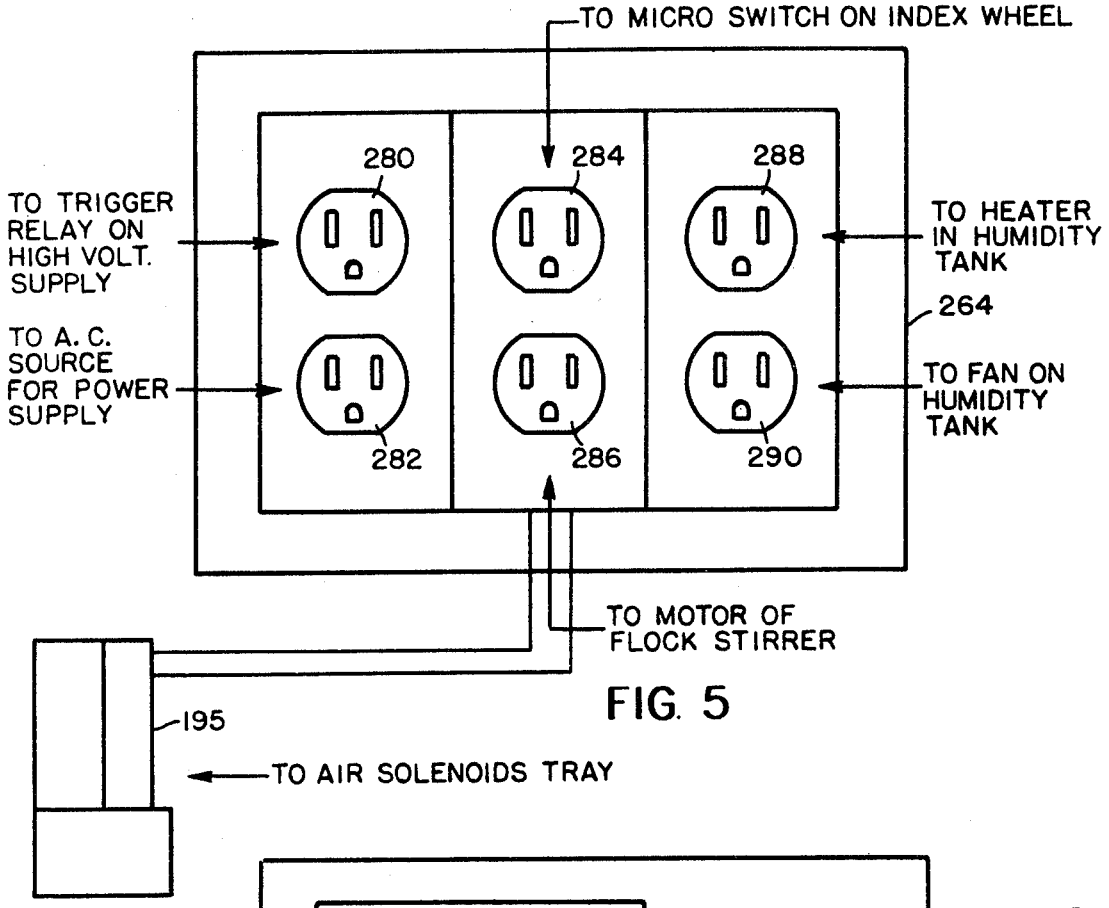
FIG. 5 is an elevational view of the master control outlet box of the flocking machine of FIGS. 1–4.

The electrical system of the flocking machine 10 is shown in FIGS. 5, 6, 7A and 7B. FIG. 5 is a view of the master control outlet box 264 having plugs 280–290. Plug 280 is for connection to the relay on the high voltage supply, outlet 282 is for connection to an AC source for the power supply, outlet 284 is for connection to the microswitch 94 on the index wheel, outlet 286 is for connection to the motor 188 of the flock stirrer, outlet 288 is for connection to the heater 226 in the humidifier tank 204, and outlet 290 is for connection to the humidifier fan 212. In addition, FIG. 5 shows the connection to the air solenoid valve 195.

Figure 6:
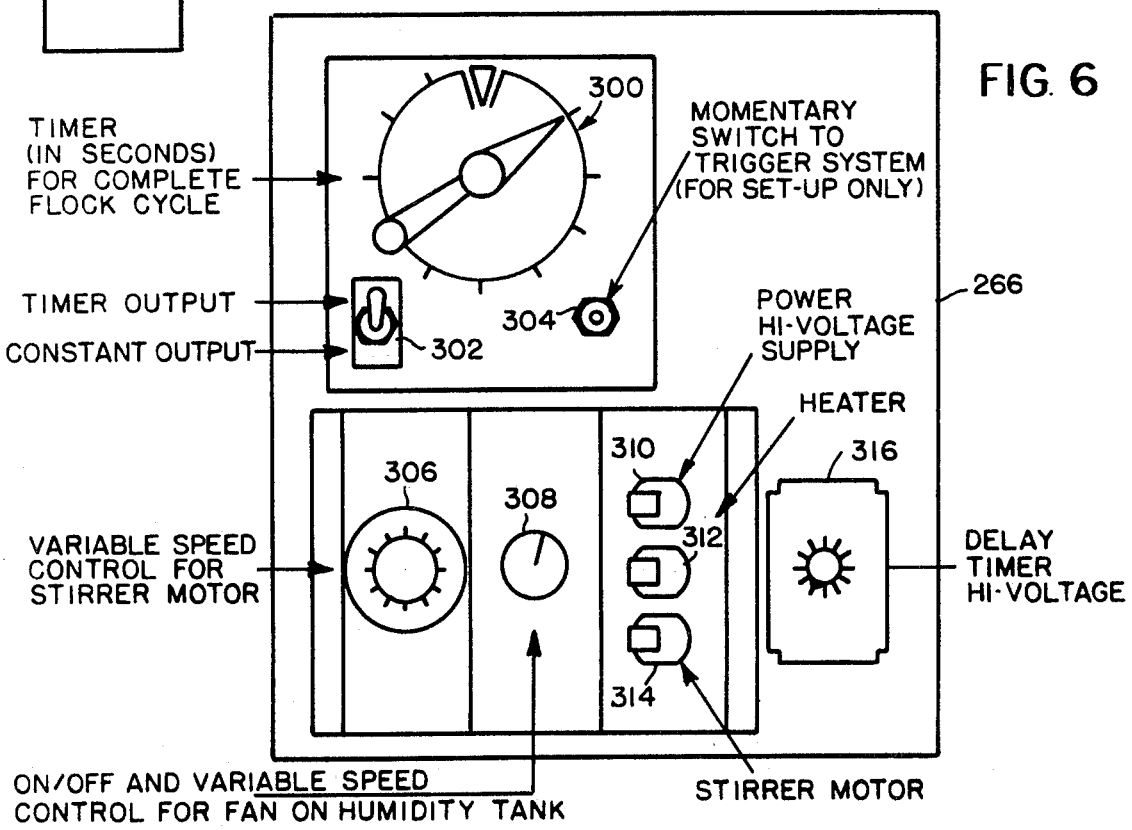
FIG. 6 is an elevational view of the information control panel of the flocking machine of FIGS. 1–4, and FIGS. 7A and 7B are electrical schematics showing the basic wiring diagrams for the flocking machine of FIGS. 1–4.

FIG. 6 is a view of the control panel in the master control box 266 and shows a timer 300 with indicia caliberated in seconds for the complete flock cycle, a switch 302 having a timed output position (for example, the up position) and a constant output position (for example, the down switch position), and a momentary switch 304 to trigger the entire system for use during the set up only. FIG. 6 also shows on the control panel, a variable speed control 306 for controlling the speed of the impellor motor 188, an on/off and variable control switch 308 for controlling the speed of the fan 212 on the humidifier tank, and a plurality of switches 310, 312 and 314. Switch 312 is an on/off switch for the high voltage supply, switch 312 is an on/off switch for the heater 226 in the humidity tank 204, and switch 314 is an on/off switch for the impellor motor 188.

Figure 7A:
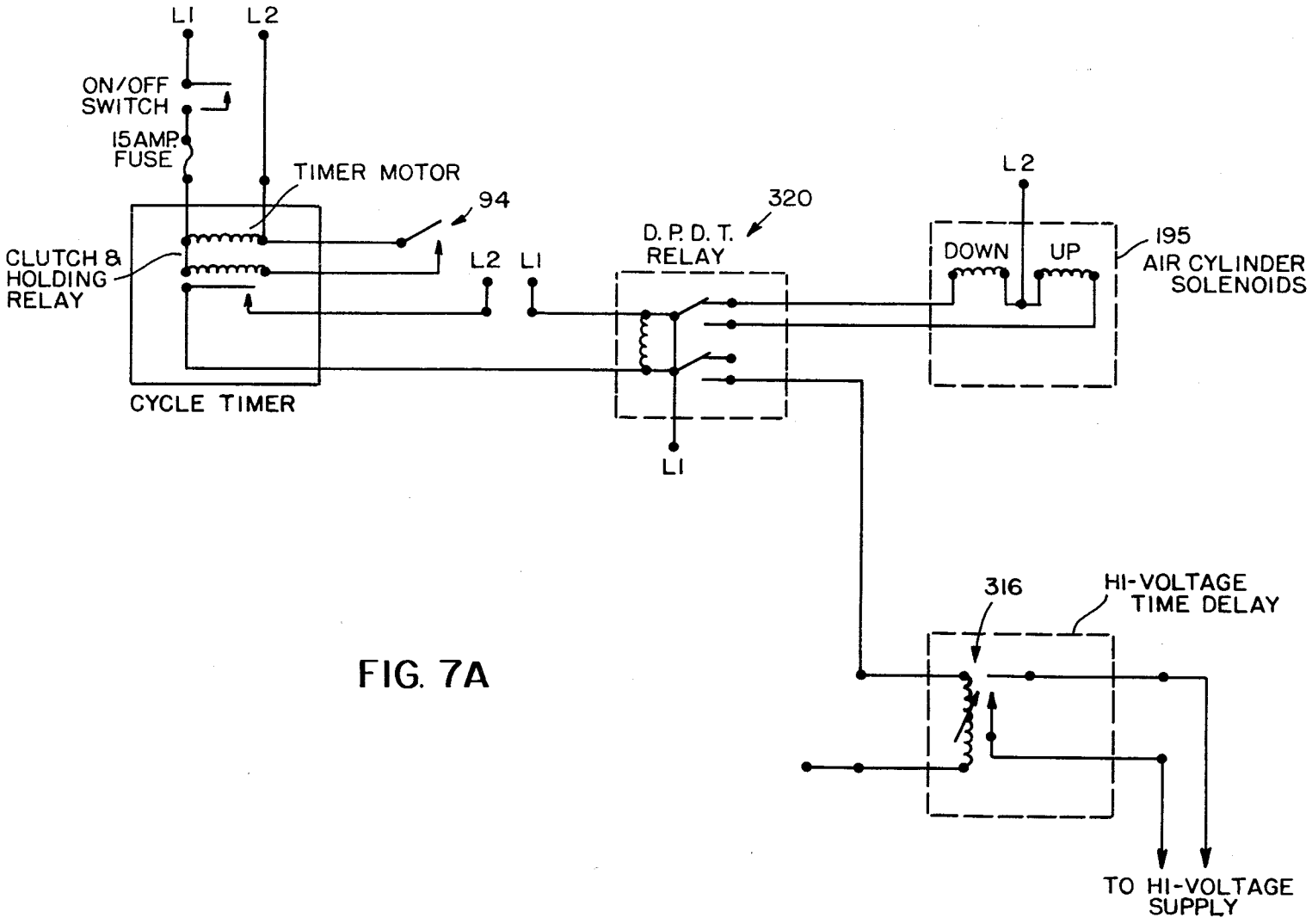

The timer 300 (including a timer motor and a clutch and holding relay) as shown in FIG. 7A carries out the flock cycle functions, that is, the required amount of time for a particular type of flock to be applied to the adhesive. For example, if the timer is set at 14 seconds, the "up" solenoid is immediately energized by energizing the relay 320 for about seven seconds (also closing the circuit to the high voltage time delay 316) and then de-energizing relay 320, whereby the relay will spring bias the contacts back to the position shown in FIG. 7A, thus energizing the "down" solenoid and opening the circuit to the high voltage system. The clutch holding relay in FIG. 7 times the flocking cycle to obtain good even flock coverage eliminating many of the undesirable effects such as balling, etc. In addition, FIG. 6 shows a delay timer 316 for the high voltage to insure that the flock tray 136 is completely in the up position before the high voltage goes on.

Figure 7B:
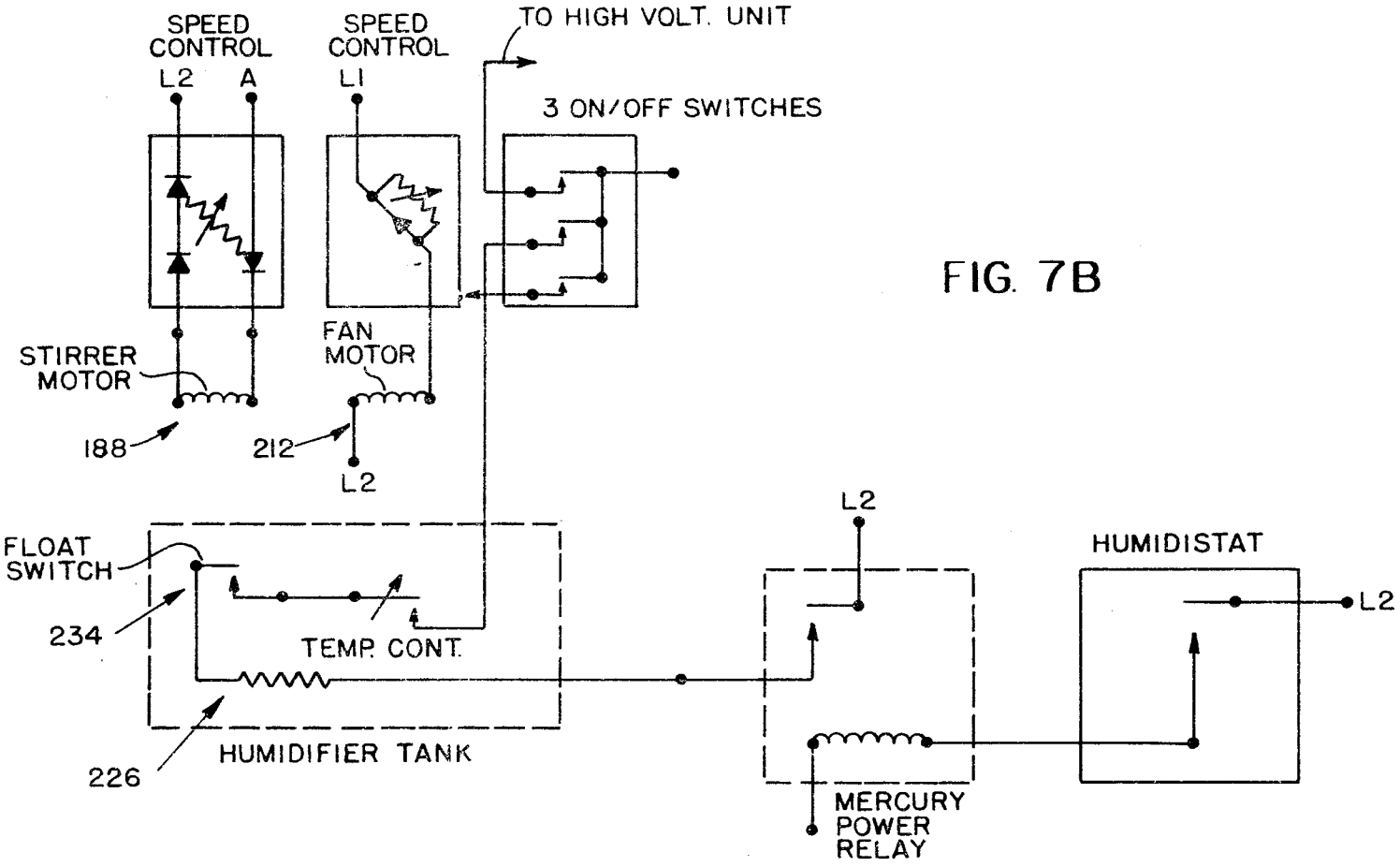

FIG. 7A and 7B are electrical schematics showing the basic wiring diagrams for the flocking machine 10. From FIG. 7A, it will be seen that when the microswitch 94 on the index wheel is closed by rotation of the turret, electrical energy will be sent: (1) to both the "up" air cylinder solenoid (because the D.P.D.T. relay 320 is caused by the timer 300 to move the switches to the other position than that shown in FIG. 7A) and also (2) to the electrode 142 through the high voltage delay timer 316 shown in FIG. 6 whereby after a predetermined time delay, for example, 3 seconds the high voltage is then supplied to the electrode 142. After the predetermined period of time, for example 7 seconds, as set by the timer 300 the relay 320 switches back to its position shown in FIG. 7A causing the down solenoid to be energized sending the flock tray down and opening the circuit to the high voltage electrode 142, and then opening the microswitch 94. The timer 300 is a conventional off the shelf timer.

As previously discussed, in the preferred embodiment the electrode 142 in the flock tray 136 is connected to the positive terminal of the electrical system while the electrically conductive platens 78 are grounded. The cabinet 12, as well as all of the flock trays are non-metallic. They are preferably made of plastic. In this way the electric field lines of force between the electrode 142 and the platen 78 are parallel to each other, are perpendicular to the garment to be flocked, and are uniform as contrasted to prior art wherein the cabinet and various portions of the apparatus adjacent the flocking station are metallic. In the present invention, the cabinet 12 is preferably made of wood. Regarding the electrostatic field, no metallic substance is close enough to affect the electrostatic field, whereby a target-type pattern or a zebra-type lay down of flock on the adhesive and substrate as often occurs in the prior art is avoided. The flock moves in a straight pattern from the flock tray up to the adhesive and substrate. In prior art systems, this is not the case and a funnel-like flow of flock from the center outward to the cabinetry exists giving poor quality flock coverage.

The power supply installed in the machine 10 can include a control panel with a KV/DC meter (or AC meter, depending on which system is used), an output voltage regulator, on/off switch, pilot light system and a fuse. The total power pack is placed inside the cabinet with an access port covered by a plastic door with a lock/key system allowing only authorized personnel to make voltage adjustments. Also connected externally, immediately above the power supply, is a proper grounding system in which the ground wire goes to a positive ground system. All metal is thus grounded including the screen holding mechanism, to prevent ink splatters on the garments due to undesired stray electrostatic fields.

Within easy reach to an operator, on the side of the machine 10 is a control box 266. Inside of this box 266 (see FIG. 6) is a variable speed control 306 for the flock agitator, a timer 300 for the flock cycle, and a time delay timer 316 for turning the high voltage on after the flock tray has started to move up to the flocking position. This feature provides that no flock will come up out of the tray while the tray is in the process of moving up. The delay ensures that the electrostatic field will only be energized after the flock tray is up in direct contact with the platen on which is the substrate with the adhesive.

For a given machine and given air pressure and stroke of the flock tray, the delay timer 316 is set so as not to energize a switch supplying electrical power to the electrode 142 until the preset time delay has occurred, at which time the tray will be in contact with a platen 78. Other ways of doing this can be used to insure that the electrode is not energized until the flock tray contacts the platen.

In the prior art, when the tray starts up, a microswitch is closed and the electric field goes on, whereas in the present invention the microswitch waits for contact with the garment because of the timer.

In the present invention, a full cycle will take about 7 seconds or less and a single operator can produce 80–140 dozen flocked garments a day. In the prior art it took two operators to produce 80–100 dozen flocked garments a day. The flocking portion of the cycle will take approximately 3–7 seconds. It is noted that a small flock design may take about 4 grams of flock, a large design may take 16 grams and the flock tray 136 holds approximately 4–8 lbs of flock. One pound of rayon flock will cover an area of from about 60 to 100 square feet.

While, as described above, the operator may prefer to take the garment off from the uppermost platen, the garment can alternatively be removed from the lower platen as soon as the flock tray has lowered. This has the advantage that since some flock does drop off of the garment at this stage, it simply drops back into the flock tray.

The invention has been described in detail with particular reference to the preferred embodiments thereof, but it will be understood that variations and modifications can be effected within the spirit and scope of the invention as described hereinabove and as defined in the appended claims.

What is claimed is:

1. Apparatus for applying flock to a substrate comprising:

(a) a cabinet, (b) means connected to said cabinet including a platen for supporting a substrate to be flocked, (c) a flock tray positioned below said platen and including a bottom wall and side walls and means for moving said flock tray up and down in said cabinet and up into contact with said platen, (d) sealing means located in said cabinet between said tray and said cabinet for preventing any flock from getting into said cabinet, and (e) a flock tray cover having a bottom wall and located on top of said flock tray and having an opening in said bottom wall, and a removable mask having an opening therein and being located on top of said bottom wall of said flock tray cover.

2. The apparatus according to claim 1 wherein said sealing means also guides the upward and downward motion of said tray in said cabinet.

3. The apparatus according to claim 1 wherein said flock tray cover includes sidewalls.

4. The apparatus according to claim 1 including a rotor mounted in said flock tray for agitating the flock in the flock tray and a motor mounted in said cabinet for rotating said rotor.

5. The apparatus according to claim 1 wherein said means for moving said tray up and down comprises at least one air cylinder and a solenoid valve connected in the air line to said air cylinder and circuit means for controlling the operation of said solenoid valve and thus the upward and downward movement of said flock tray.

6. The apparatus according to claim 1 including a cabinet shaft-way for said flock tray and surrounding said flock tray, said flock tray being adapted to move up and down in said shaft-way, and wherein said sealing means comprises a pair of spaced-apart felt seals around the entire periphery of said cabinet shaft-way for said tray and in contact with said tray throughout its entire up and down movement.

7. Apparatus for applying flock to a substrate comprising:

(a) a cabinet, (b) means connected to said cabinet including a platen for supporting a substrate to be flocked, (c) a flock tray positioned below said platen and including a bottom wall and sidewalls and means for moving said flock tray up and down in said cabinet and up into contact with said platen, (d) sealing means located in said cabinet between said tray and said cabinet for preventing any flock from getting into said cabinet, said sealing means also guiding the upward and downward motion of said tray in said cabinet, and (e) a tray holder holding said flock tray and having a bottom wall and sidewalls, said sidewalls extending both upwardly and downwardly from said bottom wall and being in contact with said sealing means in all vertical positions of said flock tray.

8. The apparatus according to claim 7 including a rotor mounted in said flock tray for agitating the flock in the flock tray and a motor mounted in said cabinet for rotating said rotor and a telescoping shaft connected between said rotor and said motor for rotating said rotor while said tray moves up and down in said cabinet.

9. Apparatus for applying flock to a substrate comprising:

(a) a cabinet, (b) means connected to said cabinet including a platen for supporting a substrate to be flocked, (c) a flock tray positioned below said platen and including a bottom wall and sidewalls and means for moving said flock tray up and down in said cabinet and up into contact with said platen, (d) sealing means located in said cabinet between said tray and said cabinet for preventing any flock from getting into said cabinet, (e) a flock tray cover having a bottom wall and sidewalls and located on top of said flock tray and having an opening in said bottom wall, and (f) a removable mask having an opening therein and being located on top of said bottom wall of said flock tray cover.

10. The apparatus according to claim 9 wherein said mask is a plastic mask and including also a cardboard mask having a central opening therein and located on top of said plastic mask.

11. The apparatus according to claim 9 including a tray holder holding said flock tray and having a bottom wall and sidewalls, said sidewalls extending both upwardly and downwardly from said bottom wall and being in contact with said sealing means in all vertical positions of said flock tray.

12. The apparatus according to claim 11 including a rotor mounted in said flock tray for agitating the flock in the flock tray and a motor mounted in said cabinet for rotating said rotor and a telescoping shaft connected between said rotor and said motor for rotating said rotor while said tray moves up and down in said cabinet.

13. The apparatus according to claim 12 wherein said mask is a plastic mask and including also a cardboard mask having a central opening therein and located on top of said plastic mask.

14. Apparatus for applying flock to a substrate comprising:

(a) a cabinet, (b) means connected to said cabinet including a platen for supporting a substrate to be flocked, (c) a flock tray positioned below said platen and including a bottom wall and sidewalls and means for moving said flock tray up and down in said cabinet and up into contact with said platen, (d) sealing means located in said cabinet between said tray and said cabinet for preventing any flock from getting into said cabinet, (e) a rotor mounted in said flock tray for agitating the flock in the flock tray and a motor mounted in said cabinet for rotating said rotor, and (f) a telescoping shaft connected between said rotor and said motor for rotating said rotor while said tray moves up and down in said cabinet.

15. Apparatus for applying flock to a substrate comprising:

(a) a cabinet, (b) means connected to said cabinet including a platen for supporting a substrate to be flocked, (c) a flock tray assembly including a flock tray and means for moving said flock tray, said flock tray being positioned below said platen and including a bottom wall and sidewalls and said moving means including means for moving said flock tray up into contact with said platen and down away from said platen, (d) sealing means located between said flock tray assembly and said cabinet for preventing any flock from getting into said cabinet, and (e) said flock tray having a cover on top thereof with an opening therein, and a removable mask having an opening therein and being located on top of said cover.

16. The apparatus according to claim 15 including a rotor mounted in said flock tray for agitating the flock in the flock tray and a motor mounted in said cabinet for rotating said rotor and a telescoping shaft connected between said rotor and said motor for rotating said rotor while said tray moves up and down in said cabinet.

17. The apparatus according to claim 15 wherein said mask is a plastic mask and including also a cardboard mask having a central opening therein and located on top of said plastic mask.

18. The apparatus according to claim 15 including a tray holder holding said flock tray and having a bottom wall and sidewalls, said sidewalls extending both upwardly and downwardly from said bottom wall and being in contact with said sealing means in all vertical positions of said flock tray.

19. The apparatus according to claim 18 wherein said mask is a plastic mask and including also a cardboard mask having a central opening therein and located on top of said plastic mask.

20. The apparatus according to claim 19 including a rotor mounted in said flock tray for agitating the flock in the flock tray and a motor mounted in said cabinet for rotating said rotor and a telescoping shaft connected between said rotor and said motor for rotating said rotor while said tray moves up and down in said cabinet.

21. The apparatus according to claim 20 including a cabinet shaft-way for said flock tray and surrounding said flock tray, said flock tray being adapted to move up and down in said shaft-way, and wherein said sealing means comprises a pair of spaced-apart felt seals around the entire periphery of said cabinet shaft-way for said tray and in contact with said tray throughout its entire up and down movement.

22. The apparatus according to claim 21 wherein said seals also guide the upward and downward motion of said tray in said cabinet.

23. The apparatus according to claim 22 wherein said means for moving said tray up and down comprises at least one air cylinder and a solenoid valve connected in the air line to said air cylinder and circuit means for controlling the operation of said solenoid valve and thus the upward and downward movement of said flock tray.

* * * * *